United States Patent [19]

Chancellor

[11] 4,121,471

[45] Oct. 24, 1978

[54] ROTATING HORSEHEAD FOR OILFIELD PUMPING UNIT

[76] Inventor: Forrest E. Chancellor, P.O. Box 5578, Bakersfield, Calif. 93308

[21] Appl. No.: 812,903

[22] Filed: Jul. 5, 1977

[51] Int. Cl.[2] ..... F16H 21/32

[52] U.S. Cl. ..... 74/41

[58] Field of Search ..... 74/40, 41, 42, 43, 44, 74/45, 46, 47, 48, 49, 50, 589

[56] References Cited

U.S. PATENT DOCUMENTS

| | | | |
|---|---|---|---|
| 3,006,201 | 10/1961 | Ross | 74/41 |
| 3,208,291 | 9/1965 | Ross | 74/41 |
| 3,221,568 | 12/1965 | Ross | 74/41 |
| 3,221,569 | 12/1965 | Ross | 74/41 |

*Primary Examiner*—Robert A. Hafer
*Attorney, Agent, or Firm*—Lothrop & West

[57] ABSTRACT

A generally elliptical wheel is rotatably attached to the walking beam of an oilfield pumping unit in substantially the same position as a conventional horsehead. A polished rod cable sling is attached at one end to a polished rod hanger, the other end of the rod cable being trained over the front circumferential portion of the wheel and attached to an upper portion thereof. An anchor cable sling is attached at one end to a ground anchor located below the wheel, the other end of the anchor cable being trained over the back circumferential portion of the wheel and attached to the upper portion thereof.

Rotation of the elliptical wheel in opposite directions on the upward and the downward movement of the walking beam causes the stroke of the polished rod to exceed the extent of movement of the walking beam by a substantial amount.

The shape of the wheel is selected so that the torque exerted on the wheel by the polished rod cable is substantially equal and opposite to that exerted by the anchor cable at all positions of the wheel.

5 Claims, 9 Drawing Figures

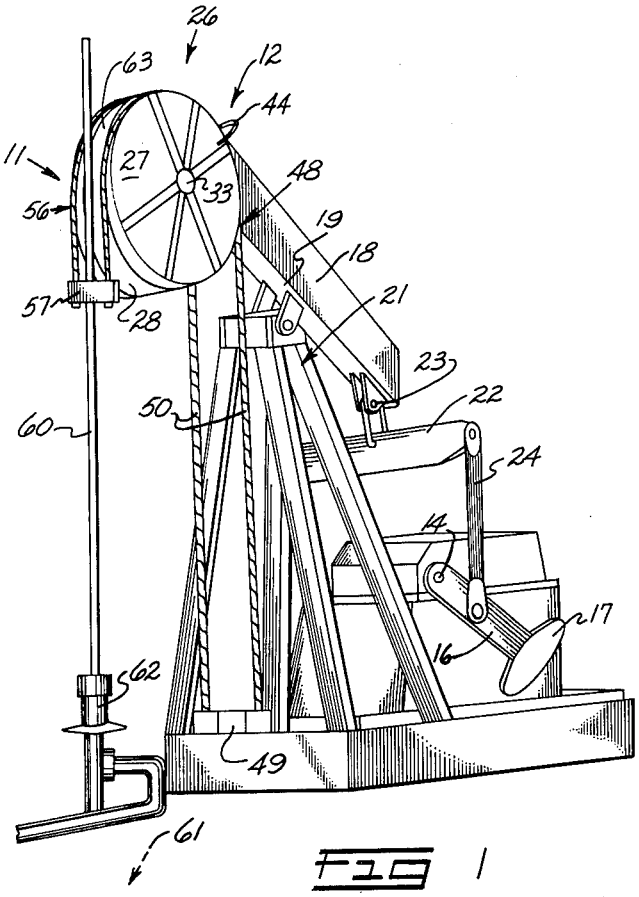
FIG 1
FIG 5
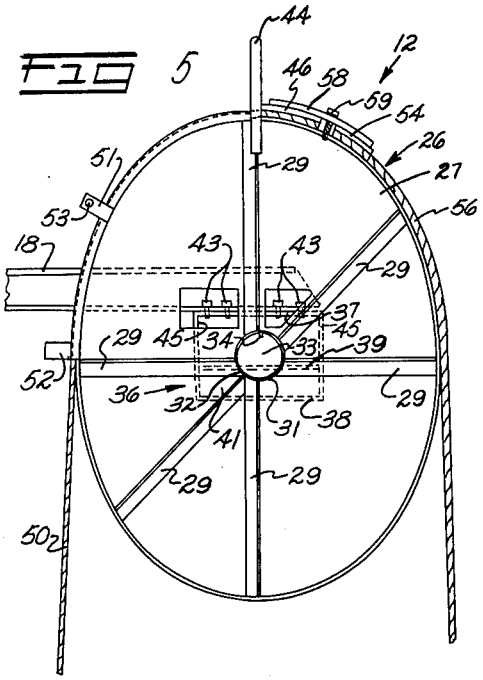
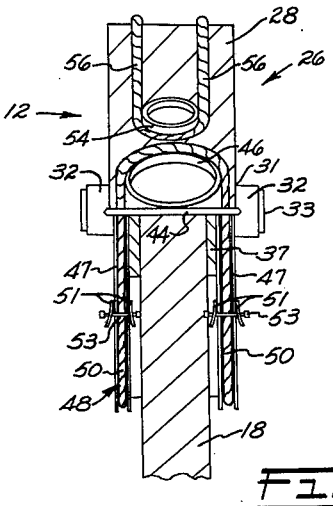
FIG 8
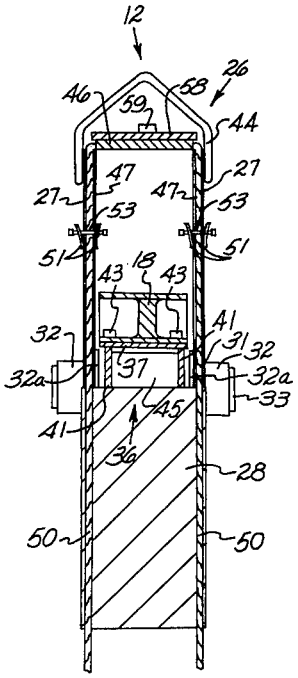
FIG 6
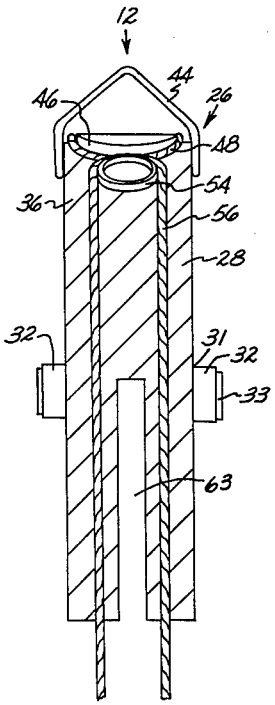
FIG 7
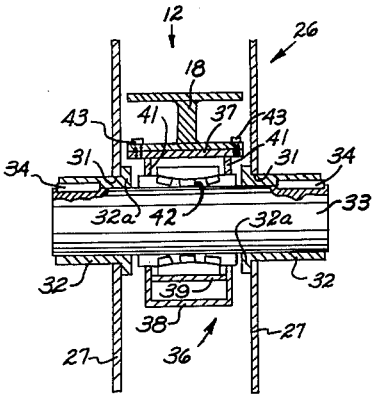
FIG 9

ROTATING HORSEHEAD FOR OILFIELD PUMPING UNIT

BACKGROUND OF THE INVENTION

A conventional oilfield pumping unit comprises a walking beam pivotally supported at a central portion thereof by a vertical tower, termed a Samson post, located adjacent the wellhead. A motor driven crank and connecting rod assembly drives the walking beam for vertical rocking reciprocation. A horsehead fixed to the end of the walking beam supports a cable sling attached to a hanger connected to a polished rod which extends vertically downwardly into the wellhead to a lift pump. The vertical rocking movement of the walking beam and horsehead causes the polished rod to reciprocate vertically of operate the pump to lift oil from the well. In such a conventional arrangement, the stroke, i.e. the extent of vertical reciprocation of the polished rod, is equal to the extent of vertical movement of the horsehead.

While oil field pumping units comprising conventional horseheads provide satisfactory performance under many operating conditions, they are unsatisfactory under circumstances where the pumping unit is underloaded, i.e. where the pumping unit is not moving the amount of fluid the unit is capable of moving because the polished rod does not provide sufficient stroke. This often occurs where considerable production volumes are to be pumped from shallow depths. In other words, the production rate of the conventional unit in such cases is substantially less than that of which it is capable owing to the relatively limited stroke of the polished rod.

SUMMARY OF THE INVENTION

The invention relates to horseheads of the type used in oilfield pumping units, and, more particularly, to horseheads which are capable of lengthening the stroke of polished rods used therewith.

It is an object of the invention to provide a rotating horsehead for an oilfield pumping unit which is capable of increasing the stroke of a polished rod at least on the order of 50%.

It is another object of the invention to increase the output of an oilfield pumping unit which is underloaded due to pumping from a shallow depth.

It is yet another object of the invention substantially to increase both the over all efficiency of an oilfield pumping unit and the production of oil from the well.

It is a further object of the invention to provide a rotating horsehead which can either be used on new oilfield pumping units or as replacements for conventional horseheads on existing units.

It is another object of the invention to provide a generally improved horsehead for an oilfield pumping unit.

Other objects, together with the foregoing, are attained in the embodiments described in the following description and illustrated in the accompanying drawing.

SHORT DESCRIPTION OF THE FIGURES

FIG. 1 is a front perspective view of an oilfield pumping unit including a rotating horsehead of the present invention;

FIG. 5 is a side elevational view, to an enlarged scale, of the rotating horsehead;

FIG. 6 is a rear elevational view of FIG. 5 with the walking beam and portions of the bearing box shown in section;

FIG. 7 is a front elevational view of FIG. 5;

FIG. 8 is a top plan view of FIG. 5; and,

FIG. 9 is a fragmentary transverse sectional of the horsehead mounting structure, to a greatly enlarged scale, viewed from the front.

DETAILED DESCRIPTION OF PREFERRED EMBODIMENT

Figure 2:
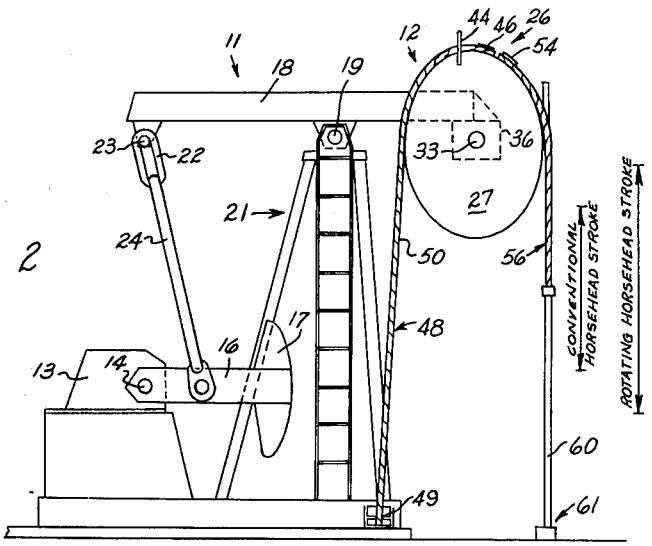
FIGS. 2, 3 and 4 are semi-diagrammatic side elevational views showing the pumping unit in three different operative positions.

While the rotating horsehead of the invention is susceptible of numerous physical embodiments, depending upon the environment and requirements of use, substantial numbers of the herein shown and described embodiment have been made, tested and used, and all have performed in an eminently satisfactory manner.

With particular reference to FIGS. 1 – 4 of the drawing, an otherwise conventional oilfield pumping unit, generally designated by the reference numeral 11, comprises a rotating horsehead 12 embodying the present invention. The pumping unit 11 includes a large enclosed electric motor and appropriate reduction gears disposed within a gear box 13. Connected to the gearing is an output shaft 14 extending transversely outwardly from both sides of the gear box 13. Crank arms 16 are attached to both ends of the output shaft 14 for integral rotation therewith, one end of each crank arm 16 being attached to the output shaft 14, and the other end of each crank arm 16 carrying a counterweight 17.

A walking beam 18 is pivotally mounted in a fore and aft direction on the top of a three legged tower 21, or Samson post, by means of a saddle bearing 19 located at an intermediate portion of the walking beam 18. A transverse beam 22 is pivotally connected to the after end of the walking beam 18 by means of a bearing 23 and connecting rods 24 are pivotally connected between the ends of the transverse beam 22 and the respective crank arms 16. With this configuration, rotation of the output shaft 14 and the crank arms 16 is transmitted to the transverse beam 22 through the connecting rods 24 thereby causing reciprocation of the transverse beam 22 and rocking reciprocation of the walking beam 18 in a vertical plane.

As appears most clearly in FIGS. 5 to 9 the rotating horsehead 12 comprises a generally elliptical wheel 26 constructed of two parallel side plates 27 of identical configuration. The side plates 27 are rigidly connected by a partial circumferential plate 28 to provide a hollow wheel. Angle members 29 are welded to the outer surfaces of the side plates 27 for reinforcement.

As can best be seen in FIG. 9, circular holes 31 are formed through the substantially central portions of the side plates 27 and in the holes 31 are snugly fitted hollow sleeves 32, or spacers. Flanges **32*a* located at the inner ends of the sleeves 32 serve to hold the sleeves in position. A transverse shaft 33 is disposed within the sleeves 32 and is secured thereto at its opposite ends by keys 34. Thus, the side plates 27 and the shaft 33** are of unitary construction.

In order rotatably to mount the horsehead 12 on the walking beam 18, the intermediate portion of the shaft 33 is disposed within a bearing box 36, or housing, the bearing box including a large upper plate 37 spaced above the shaft 33 and, below the shaft 33, a lower plate 38 and an intermediate plate 39. Two side plates 41 and two end plates 45 (see FIG. 5) are welded to the plates 37, 38 and 39 to form a rigid box-like structure which snugly encloses an anti-friction bearing 42. The bearing 42, in turn, rotatably supports the shaft 33.

The large upper plate 37 of the bearing housing 36 is fixed to the bottom surface of the forward end of the walking beam 18 by bolts 43. In this manner, the wheel 26 is rotatably supported at the forward end of the walking beam 18, the transverse shaft 33 being journaled in the bearing 42.

Also shown in the drawing is a bail 44 welded to the top of the wheel 26 by which the rotating horsehead 12 may be lifted by a crane (not shown) to mount the wheel 26 on the walking beam 18.

The upper left quadrant of the after portion of the circumferential plate 28 is cut away, as viewed in FIG. 5, to allow the walking beam 18 to extend into the wheel 26 between the side plates 27.

As viewed in FIG. 5, the left-hand portion of the wheel 26 is considered as the after, or back, side, and the right-hand portion is considered as the forward, or front, side.

As shown throughout the various figures, an anchor cable hanger 46, or bracket, in the form of a circular ring is welded to the upper portion of the circumferential plate 28 just forward of the bail 44; and anchor cable guide channels 47 are welded to the circumferences of the side plates 27 in the upper after quadrant of the wheel 26.

As shown in FIGS. 1 to 4, an anchor cable sling 48 is connected between the anchor cable bracket 46 and a fixed anchor beam 49 securely mounted below the wheel 26 at the base of the tower 21. The anchor cable sling 48 includes an anchor cable 50 arranged in the form of a loop with the open end of the loop secured at its bottom end to the anchor beam 49 and with the upper closed end of the loop looped around the circular hanger 46 on the top of the wheel 26. The anchor cable sling 48 is trained over the upper back portion of the wheel 26, anchor cable sling 48 consisting of two runs of cable 50 guidingly retained in the channels 47 of the wheel 26. It will be seen that the two runs of the anchor cable sling 48 straddle the walking beam 18. In order to retain the cable runs 50 of the anchor cable sling 48 in the channels 47, upper guide lugs 51 and lower guide lugs 52 are provided on the opposite sides of the channels 47 extending radially outwardly. A bolt 53 spans the guide lugs 51, thereby completely surrounding the anchor cable 48 in the after upper quadrant where there is the greatest tendency for the runs of the anchor cable 50 to become dislodged from the respective guide channels 47.

Circumferentially spaced clockwise from the anchor cable hanger 46 on the circumferential plate 28, as viewed in FIG. 5, is a polished rod cable hanger 54, or bracket, which is also in the form of a circular ring. A polished rod cable sling 56, which is also in the form of a loop, is connected between the upper polished rod cable bracket 54 and a depending polished rod hanger 57. The open bottom end of the loop of the cable sling 56 is connected to the depending polished rod hanger 57 and the closed upper end of the loop is looped around the polished rod cable bracket 54. The polished rod cable sling 56 is trained over the upper front portion of the wheel 26, as appears most clearly in FIG. 7.

A retaining plate 58, which covers the brackets 46 and 54, is secured to the circumferential plate 28 by a bolt 59. The retaining plate 58 prevents the cable slings 48 and 56 from becoming dislodged from the brackets 46 and 54, respectively.

As most clearly appears in FIG. 1, the polished rod hanger 57 supports a polished rod 60 of a subsurface oil pump 61. The polished rod 60 extends down through a wellhead 62 to the subsurface portion of the pump 61. The pump 61 is constructed so that vertical reciprocating movement of the polished rod 60 lifts the subsurface oil from the operating fluid level and discharges the oil to a receiving facility.

A slot 63 is provided in the lower front quadrant of the circumferential plate 28 to allow the polished rod 60 partially to enter the wheel 26 with the horsehead 12 at its upper limit of movement as will be described below.

OPERATION

The operation of the present invention will now be described with particular reference to FIGS. 2 to 4.

FIG. 2 shows the pumping unit 11 at the intermediate portion of its stroke. The crank arms 16 are horizontal, as is the walking beam 18. The generally elliptically shaped wheel 26 is oriented vertically, i.e. with the major dimension, or major axis, in vertical attitude.

Figure 3:
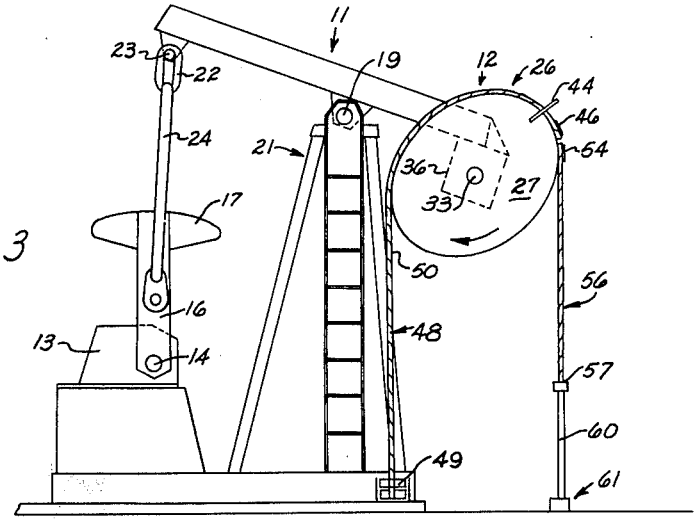

FIG. 3 shows the attitude of the pumping unit 11 with the crank arms 16 rotated from the horizontal position of FIG. 2 to an upper vertical position, with forward end of the walking beam 18 in lowermost position. The downward motion of the walking beam slackens the anchor cable sling 48. However, the weight of the polished rod 60 exerted on the wheel 26 by the polished rod cable sling 56 causes the wheel 26 to rotate clockwise, or in a forward direction, as appears in FIG. 3, until the slack in the anchor cable 48 is taken up. Thus, the polished rod cable sling 56 unwinds from the wheel 26 and the anchor cable sling 48 is wound farther onto the wheel 26. As a result, the linear downward movement of the polished rod 60 is greater than would be the linear downward movement of a walking beam 18 having a non-rotating horsehead thereon.

Figure 4:
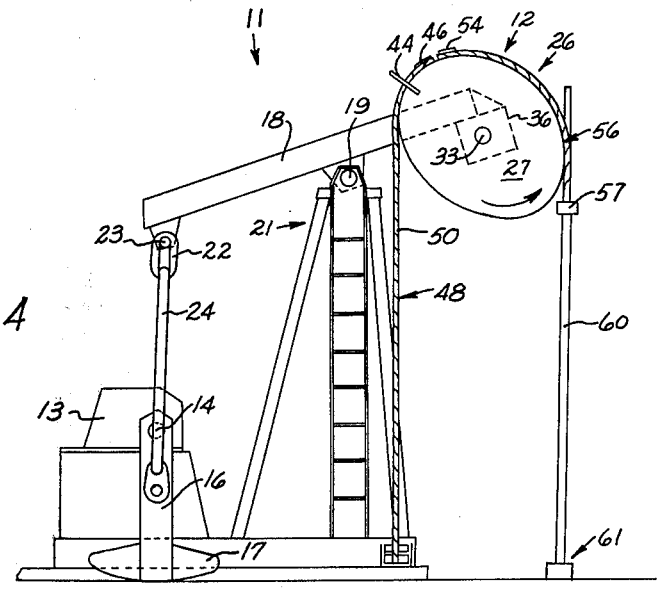

FIG. 4 shows the effect of upward rocking movement of the walking beam 18 as caused by rotation of the crank arms 16 to a lower vertical position. Due to the restraining force of the anchor cable 48, the wheel 26 is forced to rotate counterclockwise, or in a rearward direction, as shown by the arrow in FIG. 4. Thus, the anchor cable 48 is unwound from the wheel 26 and the polished rod cable 56 is wound farther onto the wheel 26. This causes the polished rod 60 to move upward by a linear distance which is greater than would be the linear upward movement of the end of the walking beam 18 having a fixed horsehead. In this position, the upper end of the polished rod 60 above the polished rod hanger 57 extends partially into the wheel 26 through the slot 63.

FIG. 2 illustrates a comparison of the stroke, or range, of vertical movement of the polished rod 58, achieved by the present rotating horsehead 12 as contrasted with the stroke of a conventional horsehead. In actual operation, it has been determined that the present rotating horsehead 12 increases the stroke by approximately 50%, which results in increased oil production by a comparable amount since the pump efficiency remains about the same.

The particular shape of the wheel is determined in such a manner that the pivotal loads on the wheel 26 are balanced, i.e. the torque exerted on the wheel 26 by the polished rod cable 56 is substantially equal and opposite to that exerted by the anchor cable 48. The shape varies in accordance with the prevailing conditions at each pumping site and may be determined either mathematically or empirically.

In summary, it will be seen that the present rotating horsehead considerably lengthens the stroke of a polished rod of a conventional oilfield pumping unit, thereby increasing efficiency and benefiting production.

What is claimed is:

1. A rotating horsehead for an oilfield pumping unit having a polished rod and a walking beam, said rotating horsehead comprising:

a. a generally elliptical wheel rotatably supported at substantially a center thereof at one end of the walking beam, said wheel including a front side and a back side;

b. a fixed anchor below said wheel;

c. an anchor cable sling attached at opposite ends to a first upper portion of said wheel and to said anchor, respectively, said anchor cable sling being trained over said back side of said wheel; and, d. a polished rod cable sling connected at opposite ends to a second upper portion of said wheel and to a polished rod vertically movable below said wheel, respectively, said polished rod cable sling being trained over said front side of said wheel.

2. A rotating horsehead as in claim 1 further comprising an anchor cable bracket fixed to said first upper portion of said wheel, said anchor cable sling being configured as a loop, the open end of the loop being connected to said anchor and the closed end of the loop being looped around said anchor cable bracket.

3. A rotating horsehead as in claim 1 further comprising a polished rod cable bracket fixed to said second upper portion of the wheel, said polished rod cable being configured as a loop, the open end of the loop being connected to the polished rod and a closed end of the loop being looped around said polished rod cable bracket.

4. A rotating horsehead as in claim 1 in which said wheel comprises two side plates and a circumferential plate spanning the side plates, said circumferential plate being cut away at said back side of said wheel to allow the walking beam to extend into said wheel between said side plates, said rotating horsehead further comprising two channels mounted on said back circumferential portion of said wheel on said side plates, the loop of said anchor cable sling having two runs guidingly retained in said two channels.

5. A rotating horsehead as in claim 1 wherein said wheel includes a transverse shaft located substantially at the center of said wheel, said shaft being journaled on said one end of the walking beam, said shaft rotating in a forward direction as said wheel is carried downwardly by the walking beam and in an after direction as said wheel is carried upwardly by the walking beam.

* * * * *